US007476045B2

(12) United States Patent
Dumler

(10) Patent No.: US 7,476,045 B2
(45) Date of Patent: Jan. 13, 2009

(54) APPLICATOR ROD

(75) Inventor: Norbert Dumler, Ansbach (DE)

(73) Assignee: Geka Brush GmbH, Bechhofen-Waizendorf (DE)

( * ) Notice: Subject to any disclaimer, the term of this patent is extended or adjusted under 35 U.S.C. 154(b) by 251 days.

(21) Appl. No.: 11/338,854

(22) Filed: Jan. 25, 2006

(65) Prior Publication Data

US 2006/0165472 A1 Jul. 27, 2006

(30) Foreign Application Priority Data

Jan. 25, 2005 (DE) ..... 10 2005 003 329

(51) Int. Cl.
*A46B 11/00* (2006.01)

(52) U.S. Cl. ..... 401/126; 401/118

(58) Field of Classification Search ..... 401/126, 401/26, 118, 119, 125, 127, 128, 129, 130
See application file for complete search history.

(56) References Cited

U.S. PATENT DOCUMENTS

| | | | | |
|---|---|---|---|---|
| 4,446,880 | A | 5/1984 | Gueret et al. | |
| 5,492,426 | A | 2/1996 | Gueret | |
| 5,620,270 | A * | 4/1997 | Gueret | 401/126 |
| 5,975,088 | A | 11/1999 | Stehman | |
| 2005/0008420 | A1 * | 1/2005 | Gueret | 401/129 |

FOREIGN PATENT DOCUMENTS

| | | | |
|---|---|---|---|
| DE | 89 14 669 | U1 | 5/1990 |
| DE | 299 12 677 | U1 | 10/1999 |
| EP | 0 612 488 | A1 | 8/1994 |
| EP | 0 701 785 | A1 | 3/1996 |
| EP | 1 050 235 | A2 | 11/2000 |
| FR | 1 191 894 | | 10/1959 |

OTHER PUBLICATIONS

European Search Report mailed received Apr. 28, 2006.

* cited by examiner

*Primary Examiner*—David Walczak
*Assistant Examiner*—Michael Barca
(74) *Attorney, Agent, or Firm*—Browdy and Neimark, P.L.L.C.

(57) ABSTRACT

An applicator rod, at the distal end of which an applicator for a cosmetic product is arranged, and the proximal end of which is designed to be connected to a sealing cap, in particular, a screw cap, for a container for holding the cosmetic product, the rod being made of injection-moulded plastic, and being characterised in that it is essentially hollow in form.

7 Claims, 1 Drawing Sheet

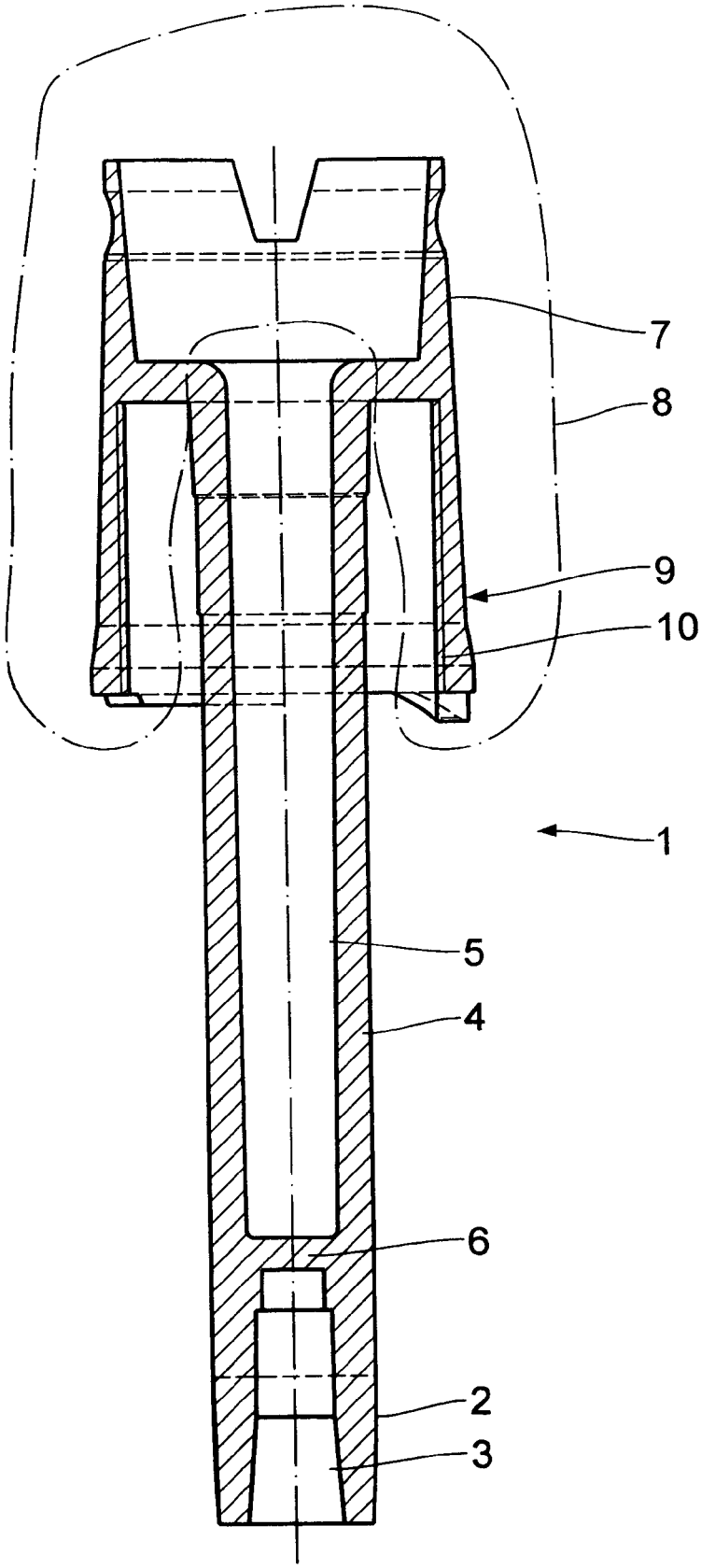
7
8
9
10
1
5
4
6
2
3

APPLICATOR ROD

BACKGROUND OF THE INVENTION

1. Field of the Invention

The invention relates to an applicator rod, at the distal end of which an applicator for a cosmetic product is arranged, and the proximal end of which is designed to be connected to a sealing cap, in particular, a cap for a container for holding the cosmetic product, the rod being made of injection-moulded plastic.

2. Background Art

An applicator rod of this type is known, for example, from DE 299 12 677 U1.

Applicators may be hairbrushes, brushes, foam formed parts or other plastic formed parts with application properties which are specially adapted to the cosmetic concerned in each case.

Usually, the rods for applicators of this type are made of solid injection-moulded plastic. It is already known from EP 1 050 235 that short rod sections can be formed as hollow parts in the area of the applicator, and provided with an opening, in order to create a fluid reservoir.

Recently, packaging units have been developed for cosmetics which require a comparatively thick or long rod for the applicator concerned in each case, or for which it is practical to use one.

SUMMARY OF THE INVENTION

On the basis of this, the object of the invention is to create a design which can be used to manufacture comparatively long and thick applicator rods also at a low cost.

This object is attained according to the invention by producing the applicator rod as a hollow form. A hollow design of this type enables the wall thickness to be reduced, and the cycle times while injecting the plastic can be significantly reduced compared to a solid rod due to the faster hardening period.

The cap is preferably a plug over cap.

In a further embodiment of the invention, the rod comprises at least one transverse wall, which is preferably formed in the area above the applicator. This transverse wall fulfils a sealing function, and prevents the fluid cosmetic product from travelling through the applicator and the inside hollow area of the rod into the cap area, where it may leak out and lead to soiling.

The applicator rod is preferably injection-moulded as a single piece, with a wall for retaining a sealing cap without a thread, which may comprise an inner thread, and with a formed sealing geometry such as flat sealing, a sealing cone or sealing ring, so that overall, highly rational production is guaranteed.

The applicator rod can be dimensioned in such a manner that it comprises a diameter of between 2 and 10 mm, and a length of up to 80 mm.

The present invention will now be described in greater detail below by way of an exemplary embodiment which is explained with reference to the drawing.

BRIEF DESCRIPTION OF THE DRAWING

This shows a longitudinal cross-section through an applicator rod according to the invention. An applicator rod 1 shown in the drawing comprises at its distal end 2 a recess 3 for retaining an applicator such as a brush.

DESCRIPTION OF A PREFERRED EMBODIMENT

The inside of the basic body 4 of the rod 1 contains a hollow chamber area 5 which runs in a longitudinal direction.

A transverse wall 6 extends across the hollow chamber area 5 in the area of the applicator above the recess 3 for the applicator, and in this manner, prevents the fluid cosmetic product from entering. The transverse wall 6 has a thickness of between 0.3 and 10 mm.

As a first option, at the proximal end 7 of the rod 1, a connecting device can be provided in the manner already known in order to create a connection with a screw cap, for example as a type of plug-like swelling, which is locked into a corresponding recess in the screw cap.

Alternatively, according to the invention, the screw cap 9 shown inside the area marked with a dot-and-dash line 8, can be injected, and is thus formed as a single piece with the rod 1. During this injection-moulding procedure, an inner thread 10 can also be injected. This achieves a particularly rational production process.

What is claimed is:

1. An applicator rod, at the distal end of which an applicator for a cosmetic product is arranged, and the proximal end of which is formed as a sealing cap for a container for holding the cosmetic product, the rod being made of injection-molded plastic, wherein the rod is formed by an elongated cylindrical wall which entirely encloses a chamber extending from a transverse wall fixed in the elongated cylindrical wall above a retainer area for the applicator up to the sealing cap, and wherein the transverse wall seals the enclosed chamber from the retainer area, and wherein the sealing cap, the elongated cylindrical wall, the transverse wall and the retaining area are all formed together as a unit.

2. The applicator rod according to claim 1, wherein the cap comprises an inner geometry which enables a form fit with a corresponding container.

3. The applicator rod according to claim 1, wherein an inner thread is provided in the form fit area.

4. The applicator rod according to claim 1, wherein the elongated wall has a diameter of between 2 and 10 mm.

5. The applicator rod according to claim 1, having a length of up to 80 mm.

6. The applicator rod according to claim 1, wherein it consists of POM, polyacetal or PBT.

7. The applicator rod according to claim 2, wherein a sealing arrangement is provided in the form of a flat, conical or ring seal.

* * * * *